US005244212A

United States Patent [19]

Bendit

[11] Patent Number: 5,244,212

[45] Date of Patent: Sep. 14, 1993

[54] CONTAINER FOR STORING CHESS PIECES

[76] Inventor: Kurt J. Bendit, 3919 - 19th Ave., San Francisco, Calif. 94114

[21] Appl. No.: 972,666

[22] Filed: Nov. 6, 1992

Related U.S. Application Data

[63] Continuation-in-part of Ser. No. 882,795, May 14, 1992, Pat. No. 5,197,742.

[51] Int. Cl.[5] ..... A63F 3/02

[52] U.S. Cl. ..... 273/239; 273/148 R; 273/285; 206/315.1; 206/579

[58] Field of Search ..... 273/285, 148 R, 286, 273/287, 282.1, 282.2, 282.3, 260, 261, 239; 206/315.1, 579

[56] References Cited

U.S. PATENT DOCUMENTS

| | | | |
|---|---|---|---|
| 166,776 | 8/1775 | Herzog | 273/285 |
| 330,990 | 11/1885 | Lundstedt | 273/285 |
| 1,534,245 | 4/1925 | Pitton | 273/282.3 |
| 2,221,267 | 11/1940 | Robertson | 273/285 |
| 2,511,774 | 6/1950 | Goldsmith | 273/239 |
| 3,023,006 | 2/1962 | Kovacs | 273/285 |
| 3,406,974 | 10/1968 | Nelson | 273/239 |
| 3,610,627 | 10/1971 | Peebles | 273/287 |
| 3,880,429 | 4/1975 | Blumenaus | 273/285 |
| 4,299,389 | 11/1981 | Miolo . | |
| 4,371,168 | 2/1983 | Dupuis | 273/239 |
| 4,696,476 | 9/1987 | Eplett | 273/241 |

FOREIGN PATENT DOCUMENTS

| | | | |
|---|---|---|---|
| 677949 | 3/1938 | Fed. Rep. of Germany | 273/290 |

*Primary Examiner*—Benjamin H. Layno
*Attorney, Agent, or Firm*—Townsend and Townsend Khourie and Crew

[57] ABSTRACT

A chess set game (2) includes a chess set (4), in which two sets of chess pieces (44) are housed within a container (8), and a chess board (6). The board can be divided into four separable quadrants (10–13) which are secured to one another. The chess pieces and the squares (38, 40) of the board have magnets (46, 42) so the chess pieces are attracted to and securely fastened to the centers of the squares. The chess board includes rank and file ID devices (50, 48) which permit the user to change file and rank indicia (54–60) according to which player has the white pieces. The container includes a rectangular bottom (70) and four sides (74–77) pivotally mounted to the outer edge (72) of the bottom. The four sides and the bottom have magnetized spaces (108, 118) against which the chess pieces are secured. Each of the sides has a top portion (82–85) extending therefrom so that when the sides are in their upright, closed positions, the top portions create a closed top (80) for the container.

12 Claims, 6 Drawing Sheets

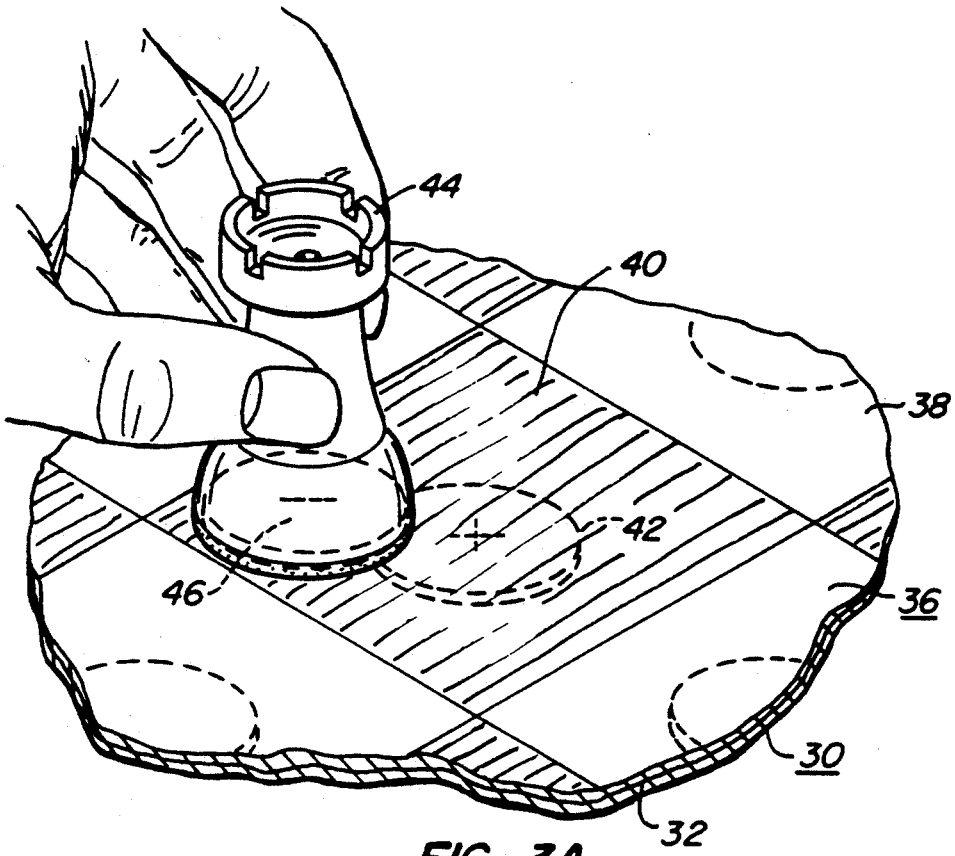
FIG. 3A.
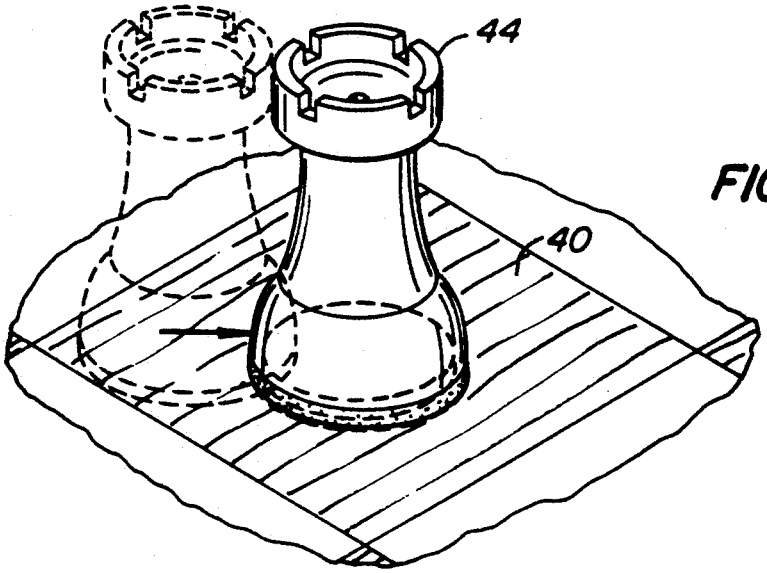
FIG. 3B.
FIG. 4.
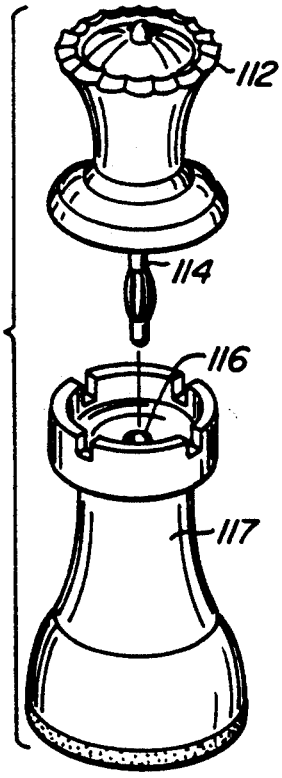

CONTAINER FOR STORING CHESS PIECES

CROSS REFERENCE TO RELATED APPLICATION

This is a continuation-in-part of U.S. patent application Ser. No. 07/882,795 filed May 14, 1992 for Chess Set Game, now U.S. Pat. No. 5,197,742.

BACKGROUND OF THE INVENTION

Chess is an ancient game played using two sets of pawns and pieces on a board with 64 spaces or squares of alternating colors, typically light and dark. Typically, the pawns and pieces are white and black, although other colors may be used as well. The pawns and pieces will be referred to in this application generically as pieces and the sets of pieces will be referred to as white pieces and black pieces. In this application a chess set game will be considered to include a chess set and a chess board. The chess set will include two sets of chess pieces (white and black) and a container for the chess pieces.

Pieces for portable chess set games are often stored in a flexible bag, a cardboard box or a wooden box, with or without foam padding. One of the problems with a mixed or jumbled set of chess pieces arises out the antisocial, competitive nature of chess. To begin a chess game with the pieces in, for example, a pouch, requires dumping the pieces onto a flat surface, usually the chess board. One player will pick out the white pieces and the other the black ones. If the players are good, the process will be a hectic one. One player will often be in a hurry to start a new game to avenge a previous loss and the other will be equally anxious to prove the victory was no fluke. As each player hurriedly sets up the pieces, some of the pieces may end up on the floor, or worse, one player will hide one or more of his or her opponent's pieces and surrender them only after having neatly set up his or her own. The same problem exists when a wooden box is dumped, except that the black and white pieces are more or less separated, assuming the pieces were separated when put into the compartmentalized box.

Another problem with chess arises particularly when using portable chess set games. Portable boards generally fold once in the middle. The resulting board is still long enough to be bulky and awkward. When played upon, they show an unsightly crease or hinge in the middle. Portable boards may also be made of thin, flexible material that is cumbersome when rolled up; they lance and poke people. When unfurled at the site of play, they have a tendency to curl back to their original rolled shape. This is especially commonplace when all the pieces are fighting in the center during a middle game.

Combination board and container chess set games usually use a box large enough for a reasonably sized board, which often allows the pieces to roam, slide and damage one another in the empty space. Some boards have a ferrous or ferromagnetic underlay and are intended to be used with magnetized pieces. However, these chess set games often suffer from inadequate magnetic attraction. This can result in a disastrous spill when playing in an unstable location causing arguments about the positions before the spill and often a tedious search for missing pieces.

The antisocial nature of chess can be exemplified by annoying tactics often employed. One tactic is to position your piece near or even upon the borders of a square. You know where your piece is but your opponent can get thrown off by its off-center placement. Your opponent has to say, "J'adoube" (adjust) before he or she may touch your ill-placed piece and then place it in the center of the square. Doing so, however, deprives the opponent of time allocated him or her by previous agreement. Another tactic some players use is floating a piece to a position just above a square but not contacting the square. This is called hovering. The general rule is touch a piece, move that piece; touch a square, leave it there. Players like to hover because it allows them to see ahead an additional move. Sometimes a player will hover interminably over a square which represents the worst move possible. This can cause the opponent to anticipate one course of action. Then the player will move with lightning speed and occupy a square which represents the best move possible. This is a technique that causes disappointment, consternation, confusion and palpitations in that order.

Still another tactic comes to the fore during speed chess such as five minute chess, 10 second chess, rapid transit chess and blitz (lightning chess). A player will flip over an entire array of pieces while making his/her move. Be it the drooping sleeve, be it through clumsiness or malice, the clock is punched and the victim's precious time disappears. The latter is probably a practitioner and master of this tactic also and thus quickly punches the clock again making the perpetrator set up the position on his own time.

All chess players record moves made during a chess match. The typical way for doing so is to use the standard file and rank ID for each square. The sides of the board where the players sit have the file identifications A through H while the lateral sides of the board have the rank identifications 1 through 8. The files and ranks are labelled from white's perspective. White always moves first, and the person playing the white pieces has the files proceeding from left to right A through H; the ranks proceed from 1 through 8 with 1 being the closest rank and 8 being the farthest. Thus, the player playing the white pieces has square A1 at his or her lower left-hand corner of the board. The player playing the black pieces has square H8 at his or her lower left-hand corner of the board. A board may have the files and ranks marked on only two contiguous sides or on all four. The former requires that black read the letters upside-down. If the numbers are not sideways, the problem of the player with the black pieces is compounded. One of the difficulties with this is that the board must be turned around before the next game with its customary color reversal. Otherwise players must play musical chairs.

SUMMARY OF THE INVENTION

The present invention is directed to a chess set game which provides stabilized placement of the pieces, substantially eliminates hovering, reduces the size of the chess board to one-fourth its normal size for transport or storage while not sacrificing the quality of the game board surface during use, provides for the organized storage, transport and retrieval of the pieces, and aids recording of game play without the need to move the board around.

The chess set game includes a chess set and a chess board. The chess set includes two sets of chess pieces housed within a container. The board can be divided into four separable quadrants for portability or storage.

The quadrants are fitted together with their edges abutting to form a square. The four quadrants can be secured to one another using magnetic sheeting attached to the backs of the quadrants. One advantage of the four-quadrant chess board is that once assembled, it has no unsightly seams or hinges showing. While only one-quarter the size of the normal board when disassembled, when assembled it provides a stable board for chess play. Another advantage of quadrants is their individual use as a blindfold chess teaching device.

Each chess piece has a magnet in its base with, in one embodiment, a first vertically oriented magnetic polar orientation. Each square on the chess board has a magnet centered in the square with a second vertically oriented magnetic polar orientation. The opposite polar orientations in this embodiment cause the chess piece to be securely fastened to the square and ensure that the chess piece placed on the square will be centered on the square. Instead of vertical polar orientations, the magnets could have generally horizontal magnetic polar orientations so that the north and south poles are parallel to the board. Doing so allows stronger magnets to be used since the pieces can be twisted to reduce or eliminate the magnetic attraction before the piece is lifted from the board. Also, horizontal magnetic polar orientations causes the magnet forces to also move the piece to its proper rotary orientation so that, for example, the horse head figure of a knight will face sideways.

The chess board preferably includes rank and file ID devices mounted along the edges of the board. The file ID devices are positioned along the sides of the board opposite the players while the rank ID devices are positioned along the lateral sides of the board. The file and rank ID devices provide the players with alternate sets of file and rank indicia to permit the players to display the proper set of file and rank indicia according to which player has the white pieces and thus starts first.

The chess piece container preferably includes a rectangular bottom and four sides pivotally mounted to the outer edges of the bottom. The four sides and the bottom have magnetized spaces against which the various chess pieces are placed. The spaces are positioned so that the pieces positioned on the sides lie between the pieces positioned on the bottom when the sides are pivoted from their outwardly extending, open positions to their upwardly extending, closed positions. Each of the sides has a top portion extending therefrom so that when the sides are in their upright, closed positions, the top portions create a closed top for the container. Two of the sides are spring biased toward the open position so that upon manually moving the other two sides to the open position, the spring biased sides automatically assume the open position as well.

The inclusion of magnets in the substrate of the container guides the pieces toward their designated locale, keeps them from dislodging, facilitates their extraction and subsequent reinsertion, affords them maximum exploitation of the limited space and prevents them from harming each other's carved decor. The convenient manner by which the sides open up to expose all the pieces allows each player to have equal access to his or her pieces thus minimizing underhanded activities that can take place when first setting up the board. Further, even a glance of the contents readily reveals anything absent or awry.

Other features and advantages of the invention will appear from the following description in which the preferred embodiments have been set forth in detail in conjunction with the accompanying drawings.

BRIEF DESCRIPTION OF THE DRAWINGS

FIG. 3A illustrates the off-center or misplacement of a chess piece on a square;

FIG. 3B illustrates the movement of the piece of FIG. 3A to a centered position because of the attraction of the magnets in the piece and the square, the magnets having opposite vertical magnetic polar orientations;

FIG. 4 illustrate the use of a crown accessory to transform a rook into a queen;

DESCRIPTION OF THE PREFERRED EMBODIMENTS

The present invention is directed to several improvements in a chess set game specially suited for portable chess set games. However, the various features of the invention need not be used only in conjunction with portable chess set games. Also, all of the novel features of the invention need not be used together.

Figure 1:
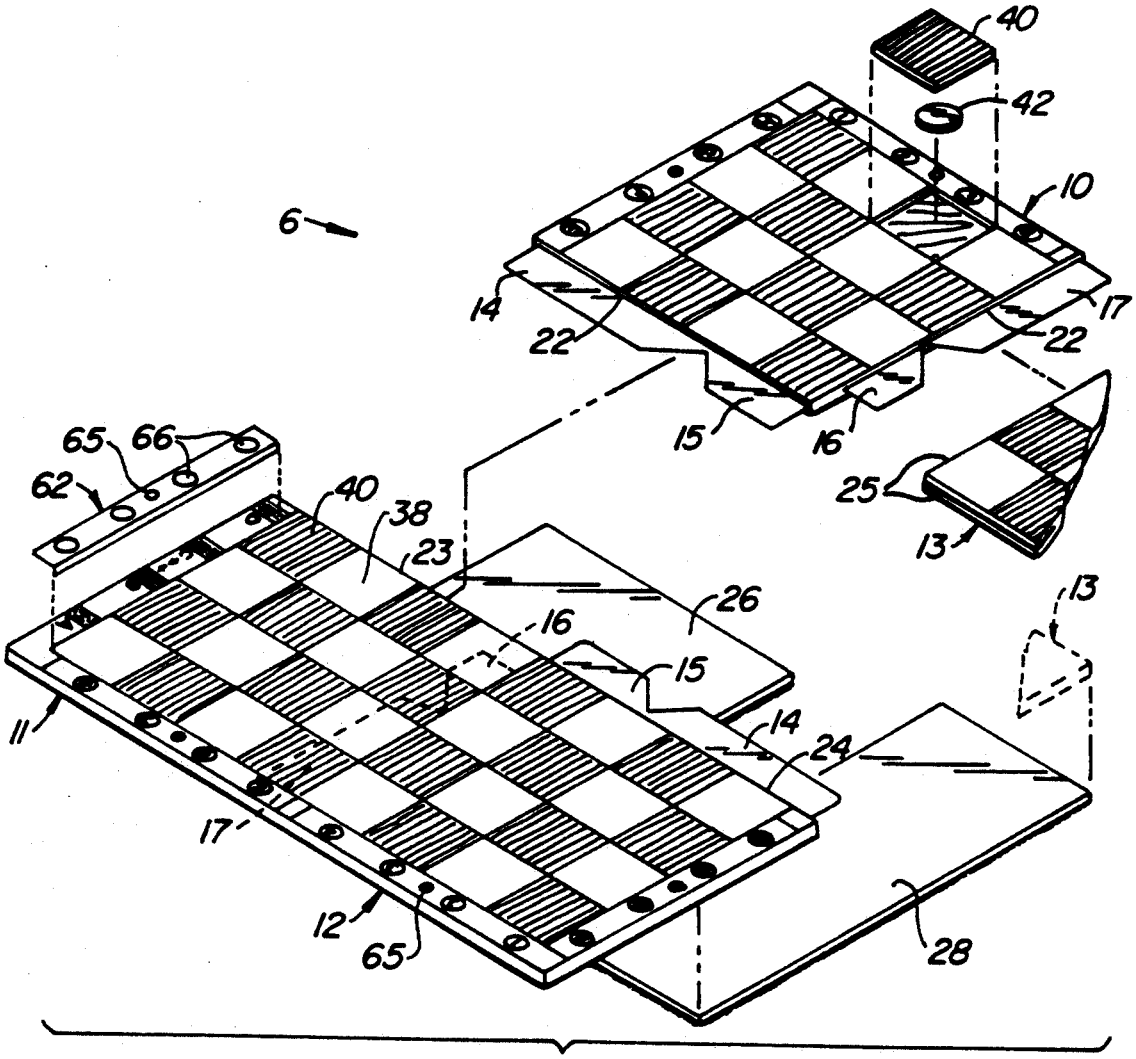
FIG. 1 is an exploded perspective view illustrating the assembly of the quadrants of a chess board made according to the invention.
Figure 1A:
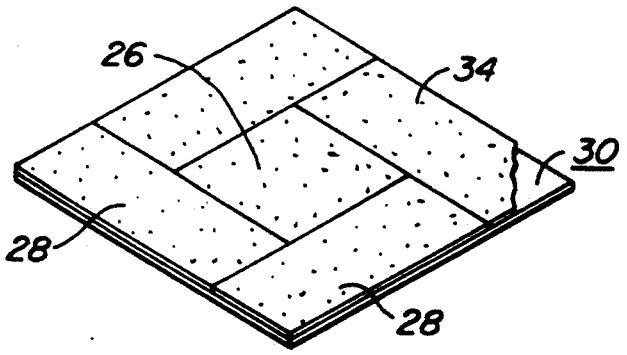
FIG. 1A is a bottom view of the assembled chess board of FIG. 1 showing the arrangement of the flexible magnetic strips on the bottom of the board.
Figure 5C:
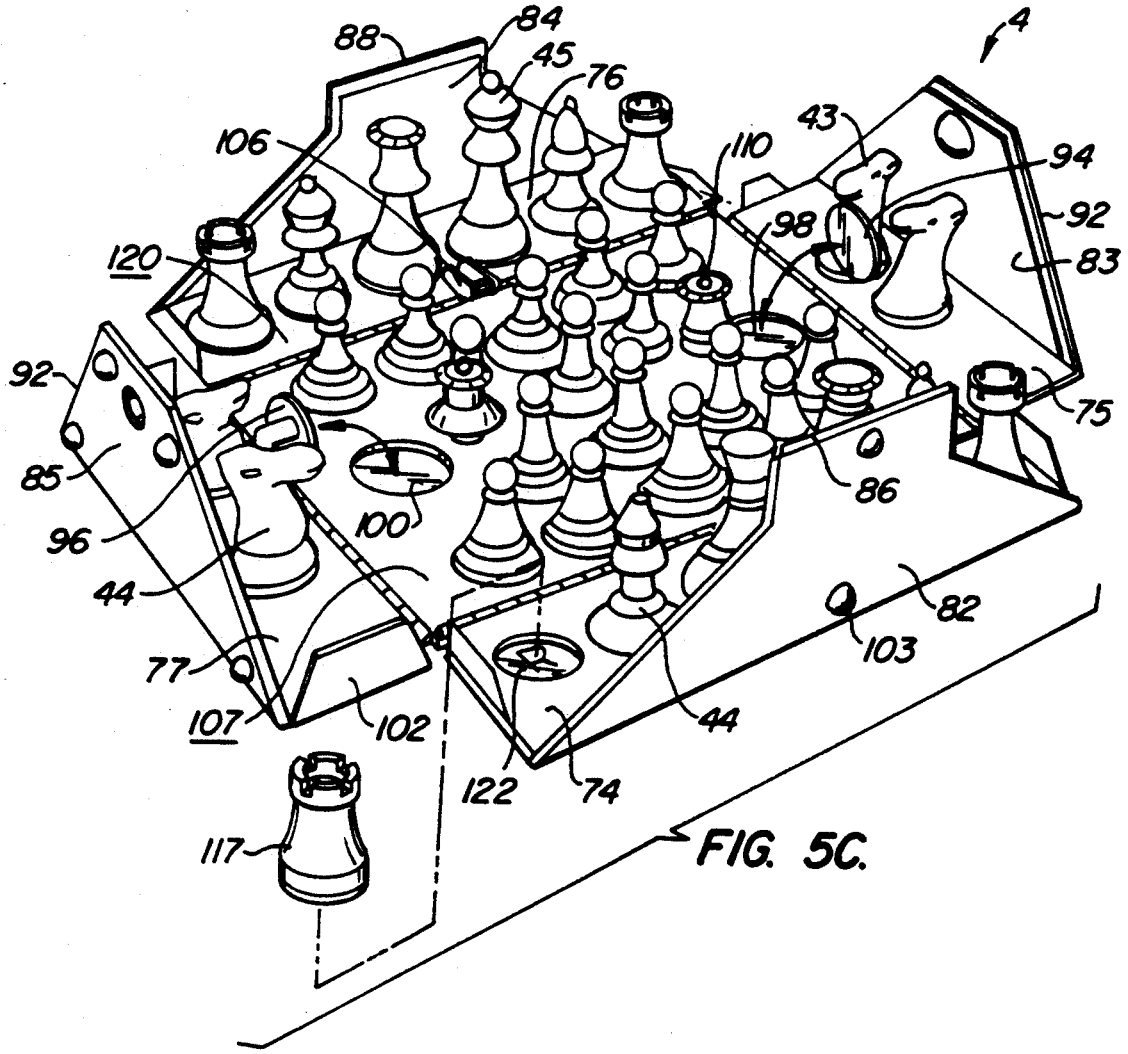
FIG. 5C illustrates the movement of the other two sides from the closed positions of FIG. 5B to the open position of FIG. 5C thus exposing all of the pieces and crowns.
Figure 1B:
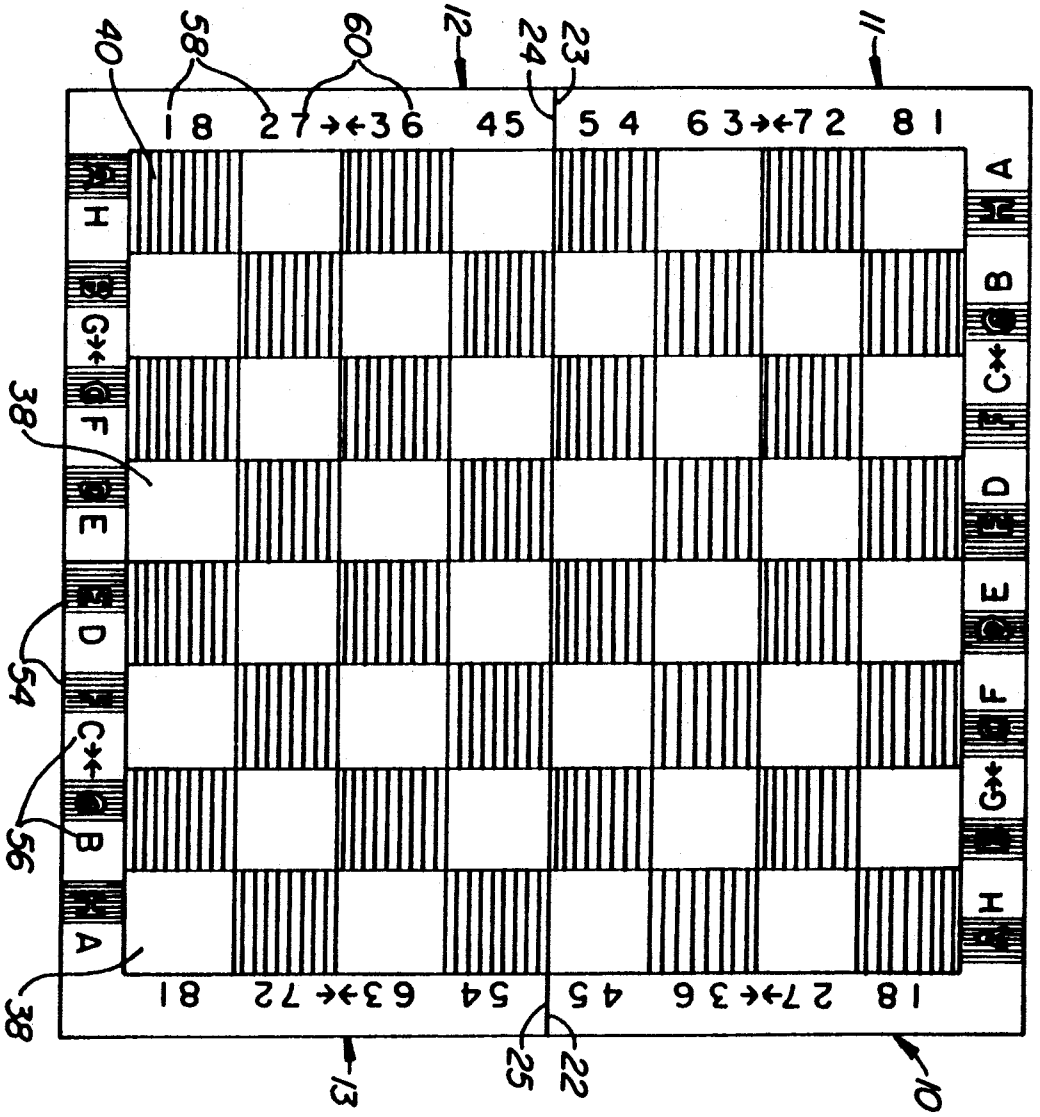
FIG. 1B is a plan view of the assembled chess board of FIG. 1 with the sliders of the file and rank ID devices removed illustrating the sets of file and rank indicia.
Figure 5A:
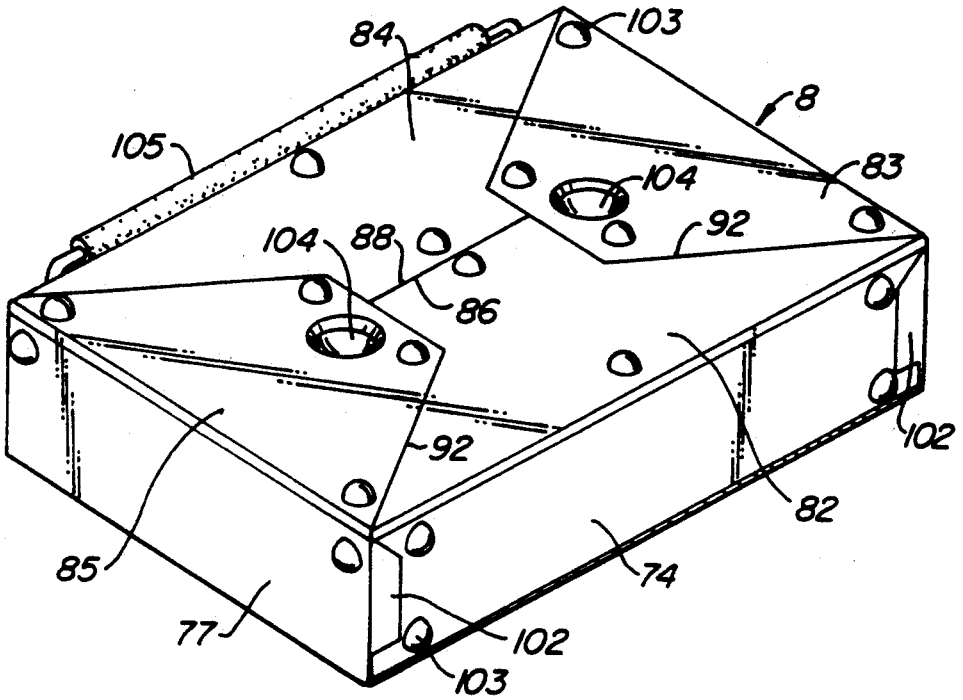
FIG. 5A illustrates a carrying container for holding two sets of chess pieces and the two crown elements of FIG. 4.
Figure 5B:
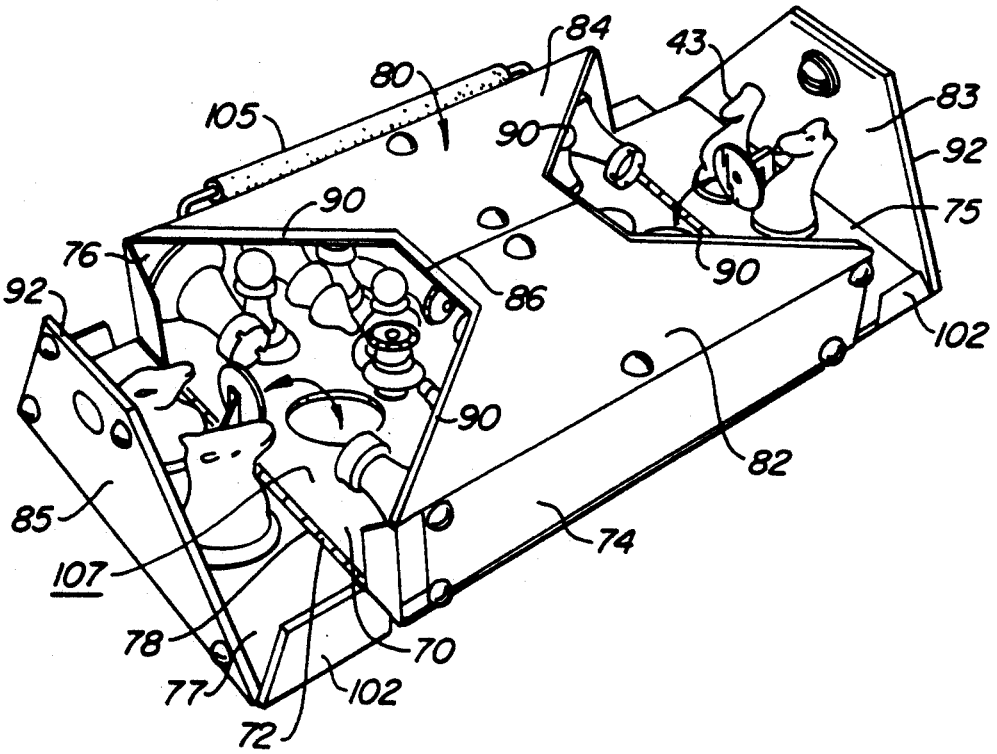
FIG. 5B shows the initial movement of two of the sides of the container from the closed position to an open position.

The invention is directed generally to a chess set game 2 including a chess set 4, shown in FIGS. 5A–5C, and a chess board 6, shown in FIGS. 1, 1A and 1B. The various aspects of the invention associated with chess board 6 will first be discussed, after which chess set 4, and particularly chess piece container 8, will be discussed.

Chess board 6 includes four quadrants 10, 11, 12, 13. First and third quadrants 10, 12 include edge guides 14, 15, 16, 17 sized and positioned to engage complementarily sized and shaped openings 18, 19, 20, 21 formed along opposed abutting edges 22, 23, 24, 25 of quadrants 11, 13. While the engagement of edge guides 14–17 into openings 18–21 provides a significant degree of stability for assembled chess board 6, flexible magnetic sheets 26, 28 are mounted to the lower, support surface 30 of chess board 6 to keep quadrants 10–13 from separating during use. Quadrants 10–13 include ferromagnetic, typically steel, layers 32 in their construction to cause sheets 28, 30 to be securely affixed to lower, support surface 30. In the preferred embodiment, sheet 26 is square in shape and is placed at a central position over assembled quadrants 10–13. Elongate rectangular sheets 28 are placed such that they overlap abutting edges 22–25 as well. In this way chess board 6 can be easily transported in a reduced size configuration, approximately one-quarter the size of the assembled chess board, and yet be assembled for stable, secure play without unsightly seams and creases. Sheets 26, 28 have a felt outer surface covering 34 to help prevent board 6 from scratching or marring a table top or other playing support surface.

Chess board 6 includes an upper, playing surface 36 divided into 64 light and dark squares 38, 40 as is conventional. Each square 38, 40 has a board magnet 42 situated beneath surface 36 and centered on the square 38, 40. Each chess piece 44 has a piece magnet 46 secured in the base. Board and piece magnets 42, 46 have opposite, vertically oriented magnetic polar orientations; this is suggested in FIG. 3A by the positive sign associated with board magnet 42 and the negative sign associated with board magnet 46. This causes magnets 42, 46 to attract one another thus attracting chess piece 44 to the centers of squares 38, 40. This has several advantages. The attraction between magnets 42, 46 creates a much stronger force holding chess piece 44 in position than is achieved if surface 36 were a simple ferromagnetic material, as is conventional. Also, if one misplaces a piece within a square 38, 40, the piece is automatically centered on the square by the magnetic attraction between magnets 42, 46 as indicated in FIG. 3B. This feature helps to minimize the effects of some of the games played by certain chess players who may misplace a piece to slow down their opponent. Also, the relatively strong magnetic attraction between magnets 42, 46 helps to eliminate hovering of a piece 44 over a square since the magnets will often pull the piece into contact with the square thus forcing the move. Further, this same relatively strong magnetic attraction effectively prevents the malicious or benign tipping over the pieces.

Figure 3C:
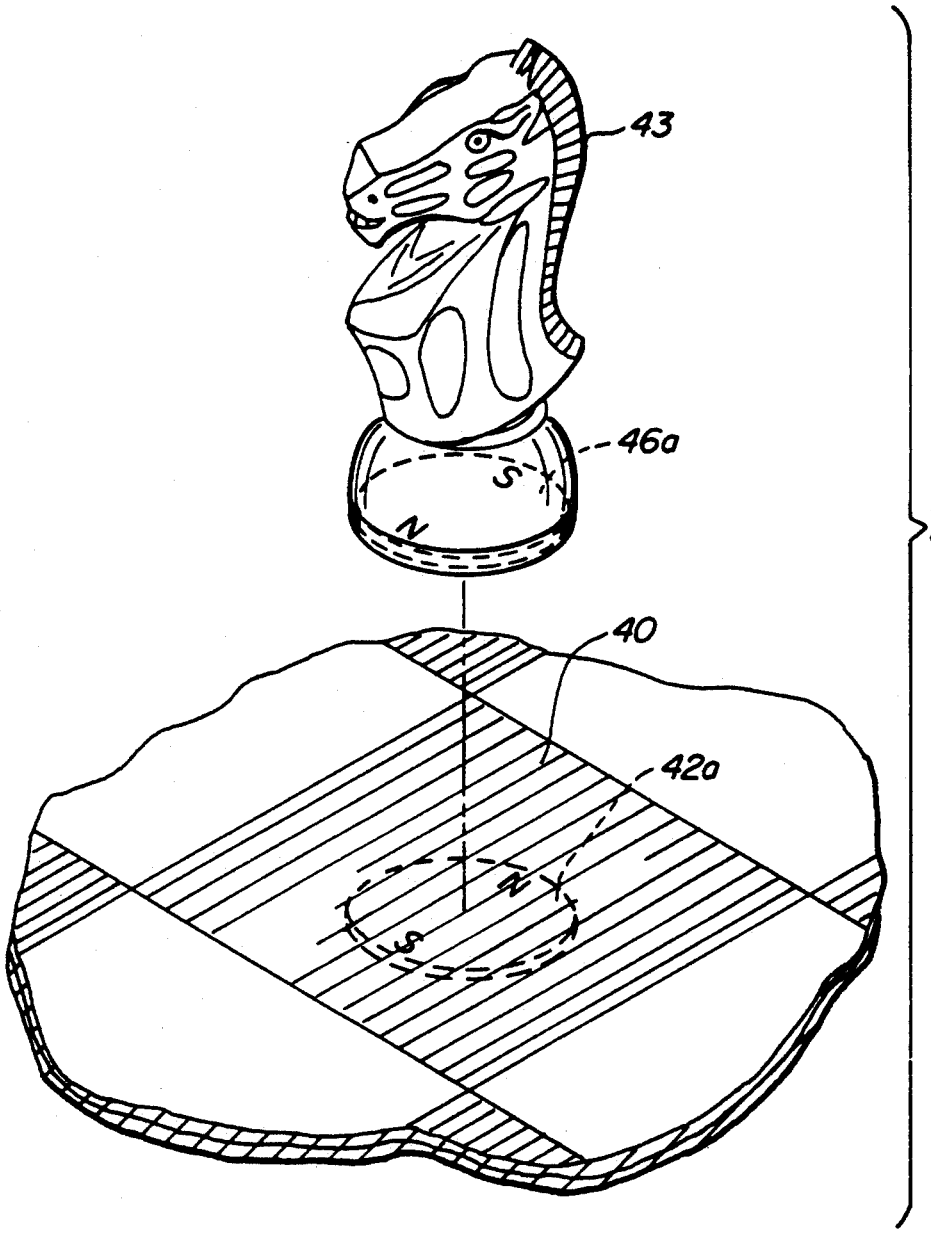
FIG. 3C is an exploded perspective view of a knight and a portion of the board illustrating the use of magnets having horizontal magnetic polar orientations.

Magnets 42, 46 could be magnets with north-south magnetic poles at opposite ends as shown in FIG. 3C. Magnets 42*a*, 46*a* thus have horizontal, that is parallel to board 6, magnetic polar orientations. This permits magnets 42*a*, 46*a* to not only center the piece on squares 38, 40, the magnets also tend to provide pieces 44 with a desired rotary orientation. While for most pieces 44 the rotary orientation, that is which way they face, does not matter, it does matter for knights 43 and kings 45 (see FIGS. 3C and 5C) since they are not radially symmetric. It is preferred that magnets 42*a*, 46*a* have their horizontal polar orientations arranged so that at the start of play black knights 43 face one another and white knights 43 face one another. It is also preferred that the cross at the top of each king 45 be oriented parallel to the ranks, that is side-to-side from the player's perspective. Magnets 42*a*, 46*a* are preferably high strength permanent magnets such as made by Magnet of Culver City, Calif. 90230, as Part No. 42B10015-M1.

One of the advantages of using magnets 42*a*, 46*a* is that pieces 44 can be firmly magnetically secured to board 6 with a strength that may not be appropriate for magnets 42, 46. This is so because pieces 44 with magnets 42*a*, 46*a*, unlike magnets 42, 46, can be removed from board 6 by first twisting the piece to substantially break the magnetic attraction to allow the piece to be easily lifted from the board. Another advantage results from the constant rotary orientation of each piece during play. Therefore, a player's king's knight will always face left and the player's queen's knight will always face right (assuming they began play facing one another). The players will quickly be able to recognize which knight is the king's or queen's knight later during play, which is sometimes important. The rooks and bishops can be marked to aid their identification if desired.

Figure 2:
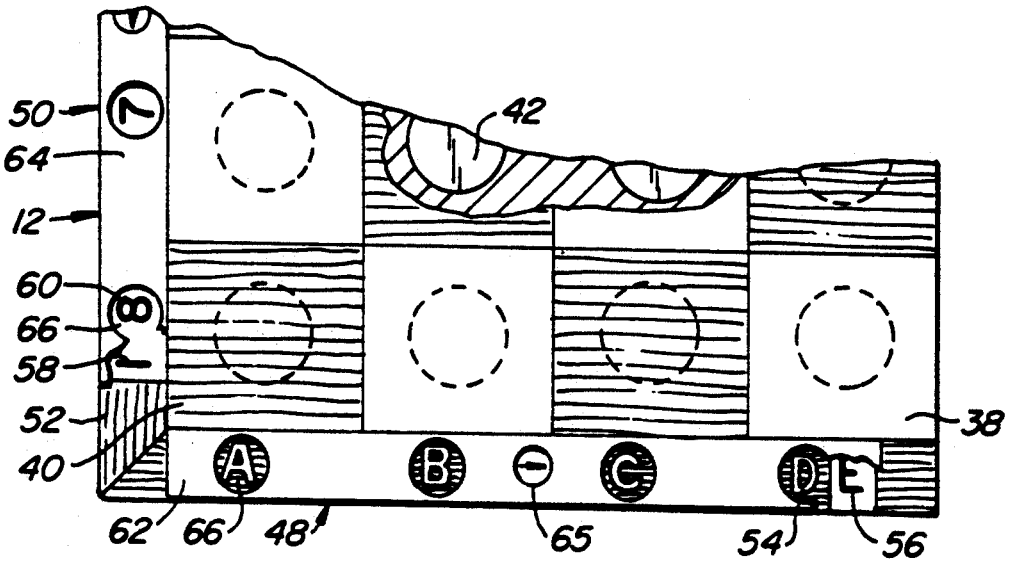
FIG. 2 is an enlarged view of a corner of one of the quadrants of FIG. 1 illustrating the rank and file ID devices and the positions of the magnets centered on each square on the board.

Chess board 6 also includes two file ID devices 48 and two rank ID devices 50. As shown in FIGS. 1B and 2, the periphery 52 of chess board 6 includes two sets of file indicia 54, 56 and two sets of rank indicia 58, 60. File and rank ID devices 48, 50 include sliders 62, 64 having openings 66 formed therein. Opening 66 and indicia 54–60 are positioned so that file indicia 54 or file indicia 56 are displayed through opening 66 according to the position of slider 62. Likewise, the position of slider 64 determines whether indicia 58 or indicia 60 are visible through opening 66 in slider 64. Which sets of indicia 54–60 are exposed can be chosen according to which player moves first and is thus playing the white pieces. For the player playing the white pieces, the square 40 at the lower left-hand corner of the board will be considered file A, rank 1. The remaining files and ranks are identified according to this convention. Thus, when the user is playing the white pieces, sliders 62, 64 will be in-the positions shown in FIG. 2 with indicia 54, 58 visible. For the next game, the user simply inserts his or her finger into a finger hole 65 and slides sliders 62, 64 from one position to the other position to allow indicia 56, 60 to be visible through opening 66 in sliders 62, 64.

As shown in FIGS. 1B and 2, indicia 54 are light colored while indicia 56 are dark colored. This corresponds to the color of the pieces being played by that player to help prevent improper positioning of sliders 62 during play. Indicia 50 and 58 are the numbers. They are all green with contrasting background. During the game the user can record the moves using conventional notations as to each position on board 6.

FIGS. 5A–5C illustrate chess piece container 8 in its closed orientation (FIG. 5A), a partially opened orientation (Fib. 5B) and a fully open orientation (FIG. 5C). Container 8 includes a bottom 70 having an outer circumferential edge 72 from which sides 74, 75, 76, 77 are pivotally connected by hinges 78. Container 8 includes a top 80 made up of four top portions 82, 83, 84, 85 all extending at right angles from associated sides 74–77. Top portion 82 has a lip 86 which overlies a correspondingly positioned lip 88 of top portion 84 when in the closed position of FIG. 5A and in the partially closed position of FIG. 5B. Top portions 82, 84 also have side lips 90 which underlie similarly positioned lips 92 formed on top portions 83, 85. Thus, top portion 82, when in the closed position, keeps top portion 84 closed and either top portions 83 or 85 keep both top portions 82, 84 closed. This is achieved magnetically using closing magnets 94, 96 extending from side walls 75, 77 which engage magnetic receptacles 98, 100 formed on bottom 70. Thus, closing combination side wall 76/top portion 84 first, side wall 74/top portion 82 second and either of the side wall 75/top portion 83 or side wall 77/top portion 85 third and fourth, causes magnetic attraction between closing magnets 94, 96 and magnetic receptacles 98, 100 to keep container in the closed position of FIG. 5. In addition to the overlap of lips 90, 92, side walls portions 75, 77 have wings 102 extending therefrom which lie against the outside of side walls 74, 76 when in the closed position.

Container 8 can also be made with other means for temporarily securing pieces 44 therein, such as hook and loop fastening material. For example, base and side storage locations 108, 118 could be covered with hook-type material and the base of each piece 44 could be covered with loop-type material. The loop-type material would act as a cushioning material much the same way as conventional felt, used on the bases of conventional chess pieces, act. Doing so would also allow container 8 to be used with conventional (non-magnetic) pieces. One could simply remove any conventional felt material from the bases of the pieces and replace it with loop-type material. Doing so would also eliminate the need for magnets at locations 108, 118 to reduce the weight and cost of container 8.

To open container 8, one grasps side wall 75/top portion 83 and side wall 77/top portion 85 using thumb depressions 104 formed in top portions 83, 85 and pivots the components outwardly. This releases side wall 74/top portion 82. Side walls 74, 76 are spring biased outwardly to the open position of FIG. 5C by spring arms 106 carried by sides 74, 76. Thus, movement of sides 75, 77 to the open position of FIG. 5B allows sides 74, 76 to automatically move to the open position thus displaying the entire set of pieces 44 housed within container 8.

Container 8 has elastomeric cushions 103 mounted to its top 80, bottom 70 and sides 74, 75, 77 to keep container 8 from scratching a support surface. Side 76 has a cushioned handle 105 pivotally secured thereto which also performs the anti-scratch function of cushions 103.

Bottom 70 includes a bottom surface 107 having 16 base storage locations 108. Locations 108 are used for the storage of pawns. Storage locations 108 include magnets of the same polarity as board magnets 42 to permit pieces 44 to be mounted securely to base storage locations 108. Similarly, sides 74–77 have a number of side storage locations 118 formed on inner side surface 120. Locations 108, 118 are identified With the color of the piece and the identity of the piece to be secured thereto. For example, FIG. 5C shows a black rook 117 removed from a side storage location 122 identified with a black R. This type of identification of storage locations 108, 118 as to both piece identity and color helps speed up packing container 8 with pieces 44.

A pair of crown elements supports 110 are used to support a pair of crown elements 112, one white and one black. Crown elements 112 each have a peg 114 which is sized to fit within a corresponding hole 116 in rook 117. See FIG. 4. This permits a previously captured rook to be transformed into a queen if and when a pawn reaches the opposing player's base rank. This eliminates the need to turn a rook upside down to signify that it is a queen, thus aiding visualization of the newly created queen as a queen without the top-heavy instability of an upside-down rook.

Locations 108, 118 are positioned to permit pieces 44 carried by sides 74–77 to nest among pieces 44 at base storage locations 108. To help prevent improperly placing one of the pieces onto magnetic receptacles 98, 100, the magnets at the magnetic receptacles have the same polar orientation as base magnets 46 so that pieces 44 are repelled by receptacles 98, 100.

To set up for a game of chess, the user first places quadrants 10–13 bottoms up and assembles the quadrants with edge guides 14–17 entering openings 18–21 so that edges 22, 23, 24, 25 abut. Magnetic rubber strip 26, which is in the shape of a square, is then placed in the center of assembled quadrants 10–13 whereby the magnetic attraction between steel layer 32 and magnetic strip 26 keeps quadrants 10–13 together. Elongate magnetic rubber strips 28 are then positioned as suggested in FIG. 1A and board 8, now assembled, is inverted so that the playing field is visible. Container 8 is then opened by grasping thumb depressions 104 and pivoting sides 75, 77 outwardly to the position of FIG. 5B. Doing so permits sides 74, 76 to pivot outwardly to the position of FIG. 5C under the influence of spring arms 106. Pieces 44 are thus appropriately displayed for the orderly transfer of the pieces to chess board 6 so that play can begin. File and rank ID devices 48, 50 are positioned according to which player has the white pieces and thus goes first. Any hovering or off-center placement of a piece 44 on a square 38, 40 is hindered or eliminated by the attraction of magnets 42, 46. If during play a pawn reaches the opponent's base rank, and assuming a rook 117 has already been lost, rook 117 can be transformed into a queen using the appropriate colored crown element 112. At the end of the game, when the piece colors change, the users need not rotate the board or switch places, but can merely move sliders 62, 64 to expose the appropriate file and rank indicia 54, 56, 58, 60.

Modification and variation can be made to the disclosed embodiments without departing from the subject of the invention as defined in the following claims. For example, the construction and materials of board 6 can be changed. Flexible magnetic sheets 26, 28 could be replaced by hook and loop fastener elements; flexible magnetic sheets 26, 28 need not cover the entire bottom surface 30.

What is claimed is:

1. A chess set comprising:

first and second sets of chess pieces, said pieces each having a base, each said base including a first attachment element;

a chess piece container including an interior bounded by an inner surface, said inner surface including a bottom surface and a sidewall surface extending from the bottom surface; and the bottom surface including a plurality of base storage locations having second attachment elements, said first and second attachment elements configured to releasably engage one another so said pieces are secured to the bottom surface when said bases of said pieces are placed against said base storage locations;

said sidewall surface includes a plurality of sidewall storage locations having said second attachment elements so that said chess pieces can be secured to the sidewall surface in addition to said bottom surface;

said bottom surface and sidewall surface are positioned perpendicularly relative to one another, said base storage locations adjacent said sidewall surface and said sidewall storage locations are relatively arranged so that chess pieces secured to the sidewall storage locations extend over the base surface and extend between chess pieces secured to said base storage locations adjacent the sidewall surface whereby the chess pieces are securely mounted within the interior of the container.

2. The chess set of claim 1 wherein the first and second attachment elements include first and second magnets having opposite polar orientation.

3. The chess set of claim 1 wherein the first and second attachment elements include hook-type and loop-type fastening material.

4. The chess set of claim 1 wherein the base storage locations are visually marked with piece identification indicia to aid proper placement of the chess pieces.

5. The chess set of claim 4 wherein the piece identification indicia are color-coded to the chess pieces to be secured thereto.

6. A chess set comprising:

first and second sets of chess pieces, said pieces each having a base, each said base including a first attachment element;

a chess piece container including an interior bounded by an inner surface, said inner surface including a bottom surface and a sidewall surface extending from the bottom surface; and the bottom surface including a plurality of base storage locations having second attachment elements, said first and second attachment elements configured to releasably engage one another so said pieces are secured to the bottom surface when said bases of said pieces are placed against said base storage locations;

said bottom surface being rectangular and having four side edges, said sidewall surface including a plurality of sidewalls, each of said four side edges having pivotally attached thereto a sidewall for movement between a closed orientation wherein the sidewalls are pivoted perpendicular to the bottom surface and an open orientation wherein the sidewalls are pivoted parallel to and extending away from the bottom surface;

means for simultaneously moving at least two of the four sidewalls from the closed orientation to the open orientation;

whereby the chess pieces are securely mounted within the interior of the container.

7. The chess set of claim 6 wherein each said side has a top portion extending therefrom, said top portions configured to be generally parallel to and spaced apart above the bottom when the sidewalls are in the closed orientation.

8. The chess set of claim 7 wherein first and second of sidewalls are positioned on opposite sidewalls of the bottom and are spring-biased towards the open orientation.

9. The chess set of claim 8 wherein the top portions of the third and fourth of said sidewalls include overlying portions which overlie portions of the top portions of the first and second sidewalls so to prevent said first and second sidewalls from moving from the closed orientation to the open orientation while the third and fourth sidewalls are in the closed orientation.

10. The chess set of claim 9 wherein the third and fourth sidewalls include magnetic means for securing the third and fourth sidewalls in the closed orientation.

11. The chess set of claim 10 wherein the magnetic means includes a first closing magnet at the bottom and a second closing magnet at the third sidewall.

12. The chess set of claim 11 wherein:

the first and second attachment elements include first and second magnets having first and second polar orientations respectively, and the first and second closing magnets have the first and second polar orientations respectively so that the chess piece magnets are repelled by the first closing magnet to help prevent improper placement of the chess pieces within the container.

* * * * *